US009049509B2

(12) United States Patent
Akino et al.

(10) Patent No.: US 9,049,509 B2
(45) Date of Patent: Jun. 2, 2015

(54) STEREO MICROPHONE

(75) Inventors: Hiroshi Akino, Tokyo (JP); Haruhito Shimura, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 524 days.

(21) Appl. No.: 13/020,314

(22) Filed: Feb. 3, 2011

(65) Prior Publication Data

US 2011/0194703 A1 Aug. 11, 2011

(30) Foreign Application Priority Data

Feb. 9, 2010 (JP) ..... 2010-026613

(51) Int. Cl.
*H04R 5/00* (2006.01)
*H03G 3/20* (2006.01)
*H04R 3/04* (2006.01)

(52) U.S. Cl.
CPC ..... *H04R 3/04* (2013.01)

(58) Field of Classification Search
CPC ..... H04R 3/04; H03G 7/02
USPC ..... 381/18, 20, 26, 57, 58, 71.1, 94.1, 318, 381/91, 92, 95, 111–115, 122; 330/86, 144
See application file for complete search history.

(56) References Cited

U.S. PATENT DOCUMENTS 3,292,495 A * 12/1966 Hill et al. ..... 409/84
4,293,742 A * 10/1981 Sato et al. ..... 381/91
5,387,879 A * 2/1995 Satoh ..... 330/282
6,246,282 B1 * 6/2001 Oono et al. ..... 330/86
7,417,459 B2 * 8/2008 Wilson et al. ..... 326/82
2003/0146790 A1 * 8/2003 Arell et al. ..... 330/296
2009/0079501 A1 * 3/2009 Watai ..... 330/254

FOREIGN PATENT DOCUMENTS

JP 2006-174136 6/2006
JP 2007-004050 1/2007
JP 2008-028574 2/2008

OTHER PUBLICATIONS

Jules Ryckebusch, A Practical MS Decoder Circuit, 2006 Bruce Bartlett, Stereo Microphone Techniques, 2006.*
Shavano, Introduction to Op-Amp, 2000.*
Jules Ryckebush, A practical MS Decoder Circuit, 2006.*
Bruce Barlett, Stereo Microphone Techniques, 2006.*

* cited by examiner

*Primary Examiner* — Vivian Chin
*Assistant Examiner* — William A Jerez Lora
(74) *Attorney, Agent, or Firm* — Whitham Curtis Christofferson & Cook, PC

(57) ABSTRACT

An output circuit of a bidirectional side microphone element includes an inverting amplifier inverting a phase and outputting an inverted signal, adds a non-inverted output signal of the side microphone element to an output signal of a middle microphone element having unidirectivity to produce a signal for one channel of the left and right channels; and adds an inverted output signal of the side microphone element being the output signal from the inverting amplifier to the output signal of the middle microphone element to produce another signal for the other channel. An input resistor and a feedback resistor to the inverting amplifier are dividable. The division ratio of the input resistor to the feedback resistor is varied to change the levels of the non-inverted output signal and the inverted output signal of the side microphone element, and to change the angle between the left and right directional axes.

12 Claims, 8 Drawing Sheets

STEREO MICROPHONE

BACKGROUND OF THE INVENTION

1. Field of the Invention

The present invention relates to a stereo microphone, specifically a technology varying the angle between the left and right directional axes, i.e., localization of a microphone used for MS stereo recording.

2. Related Background Art

One of the stereo recording techniques is MS recording, in which sound is recorded separately in a middle (M) direction and a lateral direction or side (S) directions. Microphones for MS stereo recording are commercially available. An MS stereo microphone includes a unidirectional microphone element and a bidirectional microphone element, the unidirectional microphone element picking up sound from the middle direction, the bidirectional microphone element picking up sound from the side directions. Directional axes of the microphone elements are disposed orthogonally.

FIG. 3 illustrates an example of the MS stereo microphone, which includes a middle unidirectional microphone element 10 and a bidirectional side microphone element 20. Condenser microphone elements are used for the microphone elements 10 and 20 in the example. The microphone elements 10 and 20 are mounted in a microphone case 40, more specifically in a mesh cover 42 covering the upper-half portion of the microphone case 40. The microphone element 20 is disposed above the microphone element 10. The microphone elements 10 and 20 are fixed to the microphone case 40 such that directional axes thereof are horizontal and at an angle of 90 degrees with each other. The microphone case 40 is provided with circuits described below. A connector 41 outputting output signals of the microphone to an external device is provided at the bottom of the microphone case 40.

The principle of stereo recording using the MS stereo microphone, including variable localization in MS stereo recording, is schematically explained with reference to FIGS. 8A to 8C. The left drawings in FIGS. 8A and 8B illustrate the directivity of the middle unidirectional microphone element, in which a cardioid curve is drawn as commonly known. The middle drawings in FIGS. 8A and 8B illustrate the directivity of the bidirectional side microphone element. Signs "+" and "−" in the directivity curves represent directions of the sound pressure. In MS stereo recording, the sum of the output of the middle microphone element and the output of the side microphone element yields right (R) channel signals; while the difference between the output of the middle microphone element and the output of the side microphone element yields left (L) channel signals.

The right drawing in FIG. 8A illustrates the right channel signal. Adding the output of the middle microphone element to the output of the side microphone element provides hyper cardioid directivity centering on an axis line inclining approximately 63.4 degrees to the left from the reference axis of the microphone center. The right drawing in FIG. 8B illustrates the left channel signal. Subtracting the output of the side microphone element from the output of the middle microphone element provides hyper cardioid directivity centering on an axis line inclining approximately 63.4 degrees to the right from the reference axis of the microphone center. Thereby, a sound pick-up signal having the directional axis inclining toward the right and a sound pick-up signal having the directional axis inclining toward the left can be produced. The directivity of the two sound pick-up signals is hyper cardioid and symmetric relative to the reference axis of the microphone center. Thus, a stereo signal can be produced from the two sound pick-up signals.

In FIGS. 8A and 8B, the directivity of the right channel sound pick-up signal and the directivity of the left channel sound pick-up signal theoretically incline 63.4 degrees to the right and the left, respectively, from the reference axis of the microphone center. Thus, the angle defined by the directional axes of the left and right channels is approximately 127 degrees, as shown in FIG. 8C. Such an angle of the directional axes of the left and right channels of 127 degrees is applicable to recording under most circumstances. It may be desired, however, that the angle be variable according to preference or a variety of conditions, such as spaciousness of a recorded object, and that commonly called localization thus be variable. In order to change the angle between the directional axes of the left and right channels in MS stereo recording, the output of the side microphone element may be adjusted, which is added to or subtracted from the output of the middle microphone element. Alternatively, the output level of the middle microphone element may be set to be variable, while the output level of the side microphone element may be set to be invariable, in order to change the angle between the left and right directional axes. If the angle between the left and right directional axes is too large or too small, the stereo effect is diminished and localization is unclear. In general, the lower limit of the angle between the left and right directional axes is deemed to be 90 degrees and the upper limit is 127 degrees, as shown in FIG. 8C.

A specific example of a conventional MS stereo microphone is explained below. In FIG. 4, the middle unidirectional microphone element 10 and the bidirectional side microphone element 20 are shown, as described above. The microphone elements 10 and 20, which are condenser microphone elements, are supplied with a polarization voltage from a power circuit 22 including a DC-DC converter. The power circuit 22 boosts a power source battery voltage of approximately 5V to approximately ±100V, and applies the voltage to a diaphragm and an opposed fixed plate of each of the condenser microphone elements. Output signals from the microphone elements 10 and 20 are amplified at amplifiers 11 and 21, respectively, and then output.

The microphone outputs are separated into a left channel and a right channel. For three-pin balanced output of each channel signal, a circuit configuration is provided as below. The output end of the amplifier 11 that amplifies the output of the middle microphone element 10 is connected to a second pin of the left channel through an amplifier 26. The output end of the amplifier 11 is also connected to a second pin of the right channel through an amplifier 27. The output end of the amplifier 21 that amplifies the output of the side microphone element 20 is connected to a third pin of the right channel through an amplifier 29. The output end of the amplifier 21 is also connected to an inverting input terminal of an inverting amplifier 25 that includes a differential amplifier, through an input resistor Rs. A feedback resistor Rf is connected between the output terminal and the inverting input terminal of the inverting amplifier 25. The ratio of the input resistor Rs to the feedback resistor Rf changes a phase difference of the output signal from the inverting amplifier 25. The ratio is set herein at Rs=Rf such that the phase difference between the output signal and the input signal is 180 degrees. The output end of the inverting amplifier 25 is connected to a third pin of the left channel through an amplifier 28. The amplifiers 26 to 29 are each emitter-follower-connected.

If the middle output M from the amplifier 11 has a + phase, an M+ signal is output from each of the second pins of the L channel and the R channels. The second pins are hot output terminals of the balanced output. Meanwhile, the side output S from the amplifier 21 also has a +phase. Then, an S+ signal is output from the third pin of the right channel. The phase of the side output S+ from the amplifier 21 that passes through the inverting amplifier 25 is inverted to S−. The inverted signal S− is output from the third pin of the left channel through the amplifier 28. Both the left channel signal and the right channel signal are output from a three-pin connecter as a balanced signal. First pins of the respective channels are grounded. The second pins are hot signal pins as described above, and the third pins are cold signal pins.

As described above, the signals M+ and S− are balance-output from the left channel L, and the signals M+ and S+ are balance-output from the right channel R. The balanced output of the left channel L, which is composed of the middle output M+ having a + phase on the hot side and the side output S− having a − phase on the cold side, shows the directivity centering on the axis line inclining toward the right from the reference axis, as shown in FIG. 8B. The balanced output of the right channel R, which is composed of the middle output M+ having a + phase on the hot side and the side output S+ having a + phase on the cold side, shows the directivity centering on the axis line inclining toward the left from the reference axis, as shown in FIG. 8A. Thereby, a stereo sound signal is provided.

In the MS stereo microphone described above, it may be required to narrow the sound pick-up angle from 127 degrees toward 90 degrees, for example, in a case of a narrow sound source, for example, as explained with respect to FIG. 8C. FIGS. 5 through 7 illustrate typical MS stereo microphones each having a variable sound pick-up angle.

In FIG. 5, the power circuit including the DC-DC converter is separated into a middle power circuit 221 and a side power circuit 222. For example, the power voltage of the middle power circuit 221 is fixed while the power voltage of the side power circuit 222 is variable. The polarization voltage is thus variable for the side microphone element 20. While the output level of the middle microphone element 10 is constant, the output level of the side microphone element 20, which is added to or subtracted from the output of the middle microphone element 10, can be adjusted by varying the polarization voltage. Consequently, the sound pick-up angle, or the angle of the directional axes of the left and right channels, can be varied.

The two power circuits including DC-DC converters as shown in the example of FIG. 5, however, interfere with each other to generate beat noise. Specifically, in each of the two power circuits 221 and 222, a transformer increases the voltage of an alternating signal generated by oscillation of about 1.2 MHz or switching operation. The voltage is rectified, and then increased from approximately DC 5V to approximately DC±100, for example. Furthermore, self-oscillation circuits are used in the power circuits 221 and 222 for cost reduction purposes. Since oscillation frequencies of the power circuits 221 and 222 are unstable, it is difficult to match the oscillation frequencies. As a result, beat noise is generated because of a difference between oscillation frequencies f1 and f2 of the respective power circuits. In addition, the two power circuits 221 and 222 generate signals at a relatively high frequency as described above. Thus, the two power circuits 221 and 222 easily form a magnetic coupling and easily interfere with each other, thus generating noise. Measures for noise prevention may include use of a crystal oscillator to stabilize the oscillation frequencies of the respective power circuits 221 and 222. This measure is unfavorable, however, since it leads to an increase in microphone production cost.

FIG. 6 illustrates an alternative example in which the polarization voltage is variable for the side microphone element 20. In the example, the polarization voltage for the side microphone element 20 is variable through switching of voltage-dividing resistors. Resistors Rd1, Rd2, Rd3, and Rd4 are connected in series between a +Vp output terminal and a −Vp output terminal of the power circuit 22 that supplies the polarization voltage to the middle microphone element 10 and the side microphone element 20. The output terminal of the power circuit 22 is connected to the middle microphone element 10, and thus the output voltage of the power circuit 22 is directly applied thereto. A switch 31 is provided so as to select either the +Vp output terminal of the power circuit 22 or the node of the resistors Rd1 and Rd2. A switch 32 is further provided so as to select either the −Vp output terminal of the power circuit 22 or the node of the resistors Rd3 and Rd4.

The switches 31 and 32 are operated in conjunction with each other. In a first switch setting, the output voltage of the power circuit 22 is directly applied as the polarization voltage to the side microphone element 20. In a second switch setting, a partial voltage of the resistors Rd1, Rd2, Rd3, and Rd4 is applied as the polarization voltage. In the case where the switches 31 and 32 are set as represented by a solid line in FIG. 6, the polarization voltage for the side microphone element 20 is high, and then the angle between the directional axes of the left and right channels is wide, as explained in the previous example. In the case where the switches 31 and 32 are set as represented by a broken line in FIG. 6, the polarization voltage for the side microphone element 20 is decreased, and then the angle between the directional axes of the left and right channels is narrowed, as explained in the previous example.

In the example of FIG. 6, current flows from the DC-DC converter, which is the main component of the power circuit 22, to the voltage-dividing resistors Rd1, Rd2, Rd3, and Rd4. Thus, the consumption current of the DC-DC converter increases. The DC-DC converter is provided with a rectifier. An increase in consumption current of the DC-DC converter increases a voltage drop of the rectifier, and thus decreases the output voltage. In order to prevent this, the resistance value of the voltage-dividing resistors as a whole is set to be a high value, such as, for example, 1 MΩ to minimize the current flowing to the voltage-dividing resistors. It is unavoidable, however, that the current flows to the voltage-dividing resistors. Thus, the output power of the DC-DC converter is consumed at the voltage-dividing resistors, and the current required for a signal system is limited.

FIG. 7 illustrates a further alternative example in which the angle (localization) between the directional axes of the left and right channels is variable by changing the output level of the side microphone element 20. In the example, voltage-dividing resistors Rd5, Rd6, Rd7, and Rd8 and switches 33 and 34 operating in conjunction with each other are connected to the output circuit of the inverting amplifier 25 which is connected to a side signal circuit. Thereby, the side output level is changed. The voltage-dividing resistors Rd5, Rd6, Rd7, and Rd8 are connected in series between the output end of the amplifier 21 that amplifies the output signal of the side microphone element 20 and the output end of the inverting amplifier 25. The switch 33 is connected so as to select either the output end of the inverting amplifier 25 or the node of the resistors Rd5 and Rd6, and to input the selection to the amplifier 28. The switch 34 is connected so as to select either the output end of the amplifier 21 or the node of the resistors Rd7 and Rd8, and to input the selection to the amplifier 29.

In the case where the conjunction switches 33 and 34 are set as represented by a solid line in FIG. 7, the output from the inverting amplifier 25 is directly input to the amplifier 28 while the output from the amplifier 21 is directly input to the amplifier 29. Thus, the side signals S− and S+ are input at the maximum level to the amplifiers 28 and 29, respectively, and then the angle between the directional axes of the left and right channels is wide. In the case where the conjunction switches 33 and 34 are set as represented by a broken line in FIG. 7, the output S− of the inverting amplifier 25 is voltage-divided at the voltage-dividing resistors and then is input to the amplifier 28; and the output S+ of the amplifier 21 is voltage-divided at the voltage-dividing resistors and then is input to the amplifier 29. Thus, the levels of the side signals S− and S+ input to the amplifiers 28 and 29 are decreased, and then the angle between the directional axes of the left and right channels is narrowed.

The angle between the directional axes of the left and right channels can be changed, as shown in the example of FIG. 7. In the example, however, in the case where the value of the voltage-dividing resistors Rd5, Rd6, Rd7, and Rd8 connected to the output circuit of the side signals is low, the voltage-dividing resistors are large load for the inverting amplifier 25, and thus the output signal from the inverting amplifier 25 is distorted. Increasing the value of the voltage-dividing resistors Rd5, Rd6, Rd7, and Rd8 reduces distortion of the output signal from the inverting amplifier 25. However, the level of resistance noise generated at the voltage-dividing resistors Rd5, Rd6, Rd7, and Rd8 is increased, and the signal-to-noise ratio (S/N) is degraded.

A stereo microphone disclosed in Japanese Unexamined Patent Application Publication No. 2006-174136 is known as a conventional MS stereo microphone. Furthermore, a signal-processing technology, such as coding and decoding of MS stereo signals, is also known (refer to Patent Japanese Unexamined Patent Application Publication Nos. 2008-028574 and 2007-004050, for example). However, the inventions disclosed in these patent literatures cannot change the angle between the directional axes of the left and right channels.

The configurations shown in FIGS. 5 through 7 are candidates for MS stereo microphones capable of changing the angle of the directional axes of the left and right channels. As explained above, however, the examples have problems, such as generation of beat noise from the power circuits; consumption of the output power from the DC-DC converter serving as a main component of the power circuit at the voltage-dividing resistors and limited current required for the signal system; and the voltage-dividing resistors being large load for the inverting amplifier, and distortion of the output signal of the inverting amplifier or noise generation.

SUMMARY OF THE INVENTION

In order to overcome the shortcomings related to the conventional MS stereo microphones, an object of the present invention is to provide an MS stereo condenser microphone having an improved circuit configuration in which a power circuit causes no noise and a voltage-dividing resistor causes no load to an amplifier and no noise, the microphone being capable of changing the angle of the left and right directional axes.

A main object of the present invention is to provide a stereo microphone including a middle microphone element having unidirectivity and having a directional axis, and a side microphone element having bi-directivity and having a directional axis disposed orthogonal to the directional axis of the middle unidirectional microphone element. The side microphone element has an output circuit including an inverting amplifier, the inverting amplifier inverting a phase of an output signal of the side microphone element and outputting the inverted signal. A non-inverted output signal of the side microphone element is added to an output signal of the middle microphone element to produce a first signal for one channel of left and right channels. The inverted output signal of the side microphone element being the output signal from the inverting amplifier is added to the output signal of the middle microphone element to produce a second signal for the other channel of the left and right channels. An input resistor and a feedback resistor for the inverting amplifier are dividable. A division ratio of the input resistor to the feedback resistor is varied to change the levels of the non-inverted output signal and the inverted output signal of the side microphone element to be added to the output signal of the middle microphone element, and thereby an angle between the left and right directional axes is changeable.

The division ratio of the input resistor to the feedback resistor is variable. Increasing the levels of the non-inverted output signal and the inverted output signal of the side microphone element to be added to the output signal of the middle microphone element widens the angle between the left and right directional axes. Decreasing the levels of the non-inverted output signal and the inverted output signal narrows the angle between the left and right directional axes. The angle between the left and right directional axes is changed by varying the division ratio of the input resistor to the feedback resistor for the inverting amplifier provided on a signal path from the side microphone element, which is a signal path of bidirectional components. Unlike the examples shown in FIGS. 6 and 7, the amplifiers are not overloaded by the voltage-dividing resistors, thus reducing distortion of sound signals converted by the microphone. Furthermore, the circuit configuration is relatively simple, and the input resistor and the feedback resistor do not cause noise.

DESCRIPTION OF THE PREFERRED EMBODIMENTS

Figure 3A:
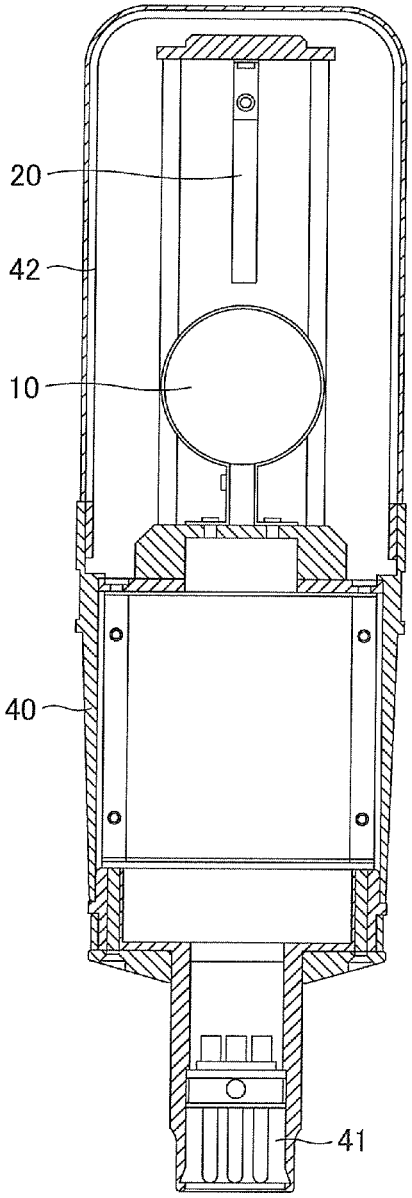
RELATED ART FIG. 3A
FIG. 3A is a front cross-sectional view illustrating a mechanical configuration of an MS stereo microphone.
Figure 3B:
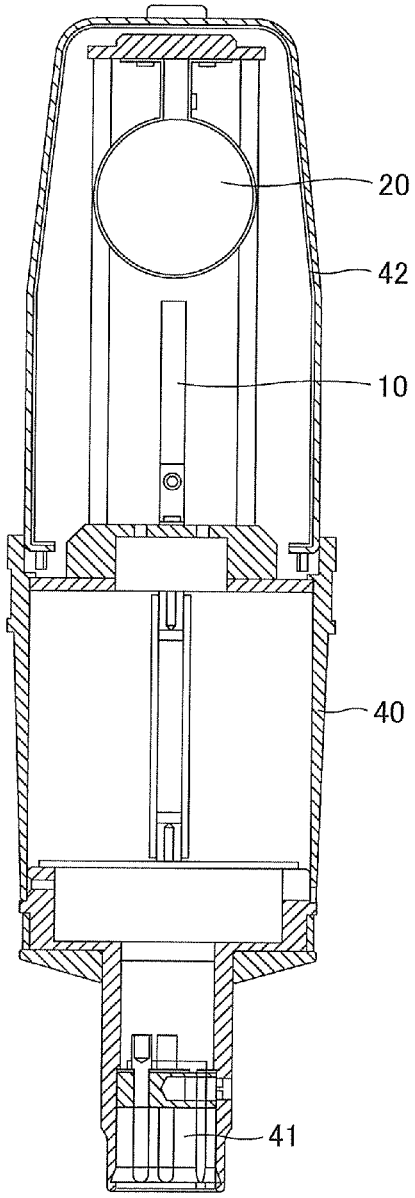
FIG. 3B is a side cross-sectional view illustrating a mechanical configuration of the MS stereo microphone.
Figure 4:
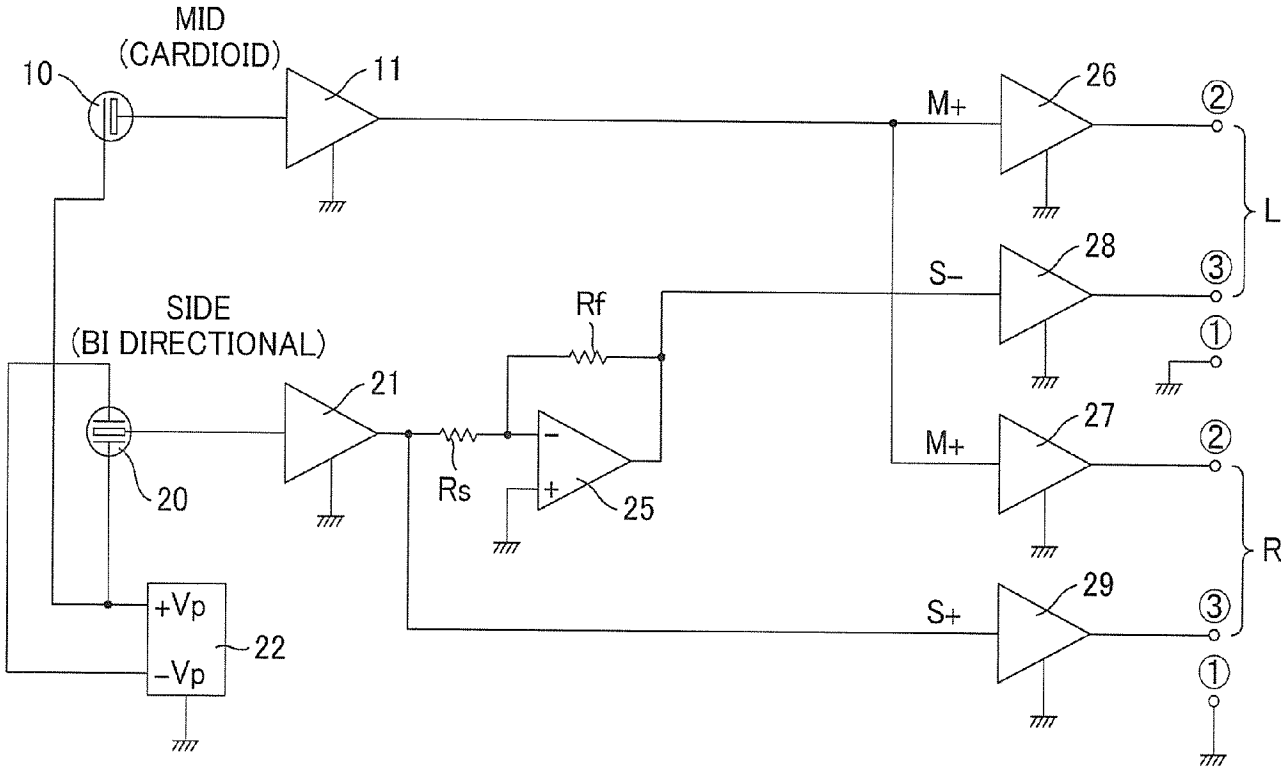
RELATED ART FIG. 4
FIG. 4 is a circuit diagram illustrating a typical conventional stereo microphone.
Figure 5:
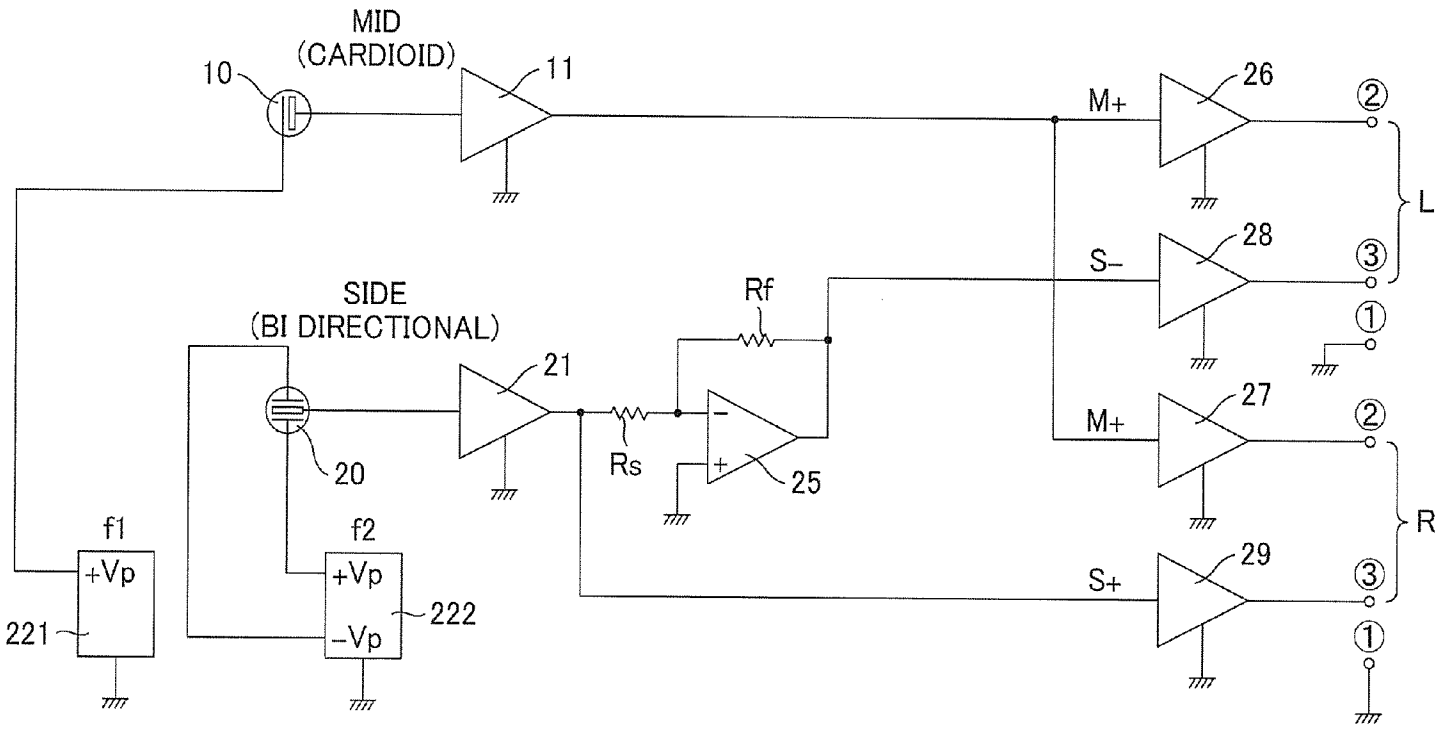
RELATED ART FIG. 5
FIG. 5 is a circuit diagram illustrating an alternative conventional stereo microphone.
Figure 6:
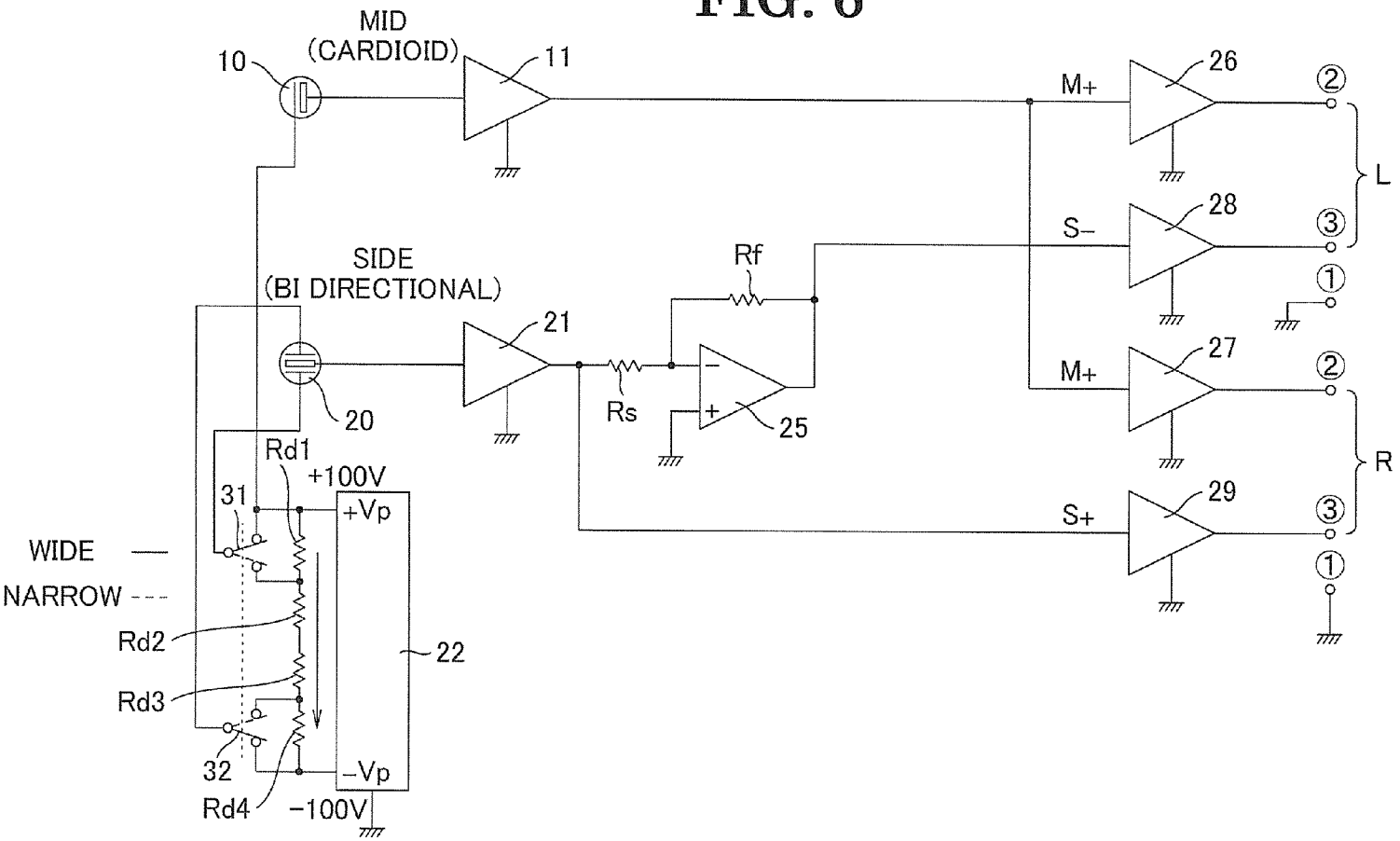
RELATED ART FIG. 6
FIG. 6 is a circuit diagram illustrating a further alternative conventional stereo microphone.
Figure 7:
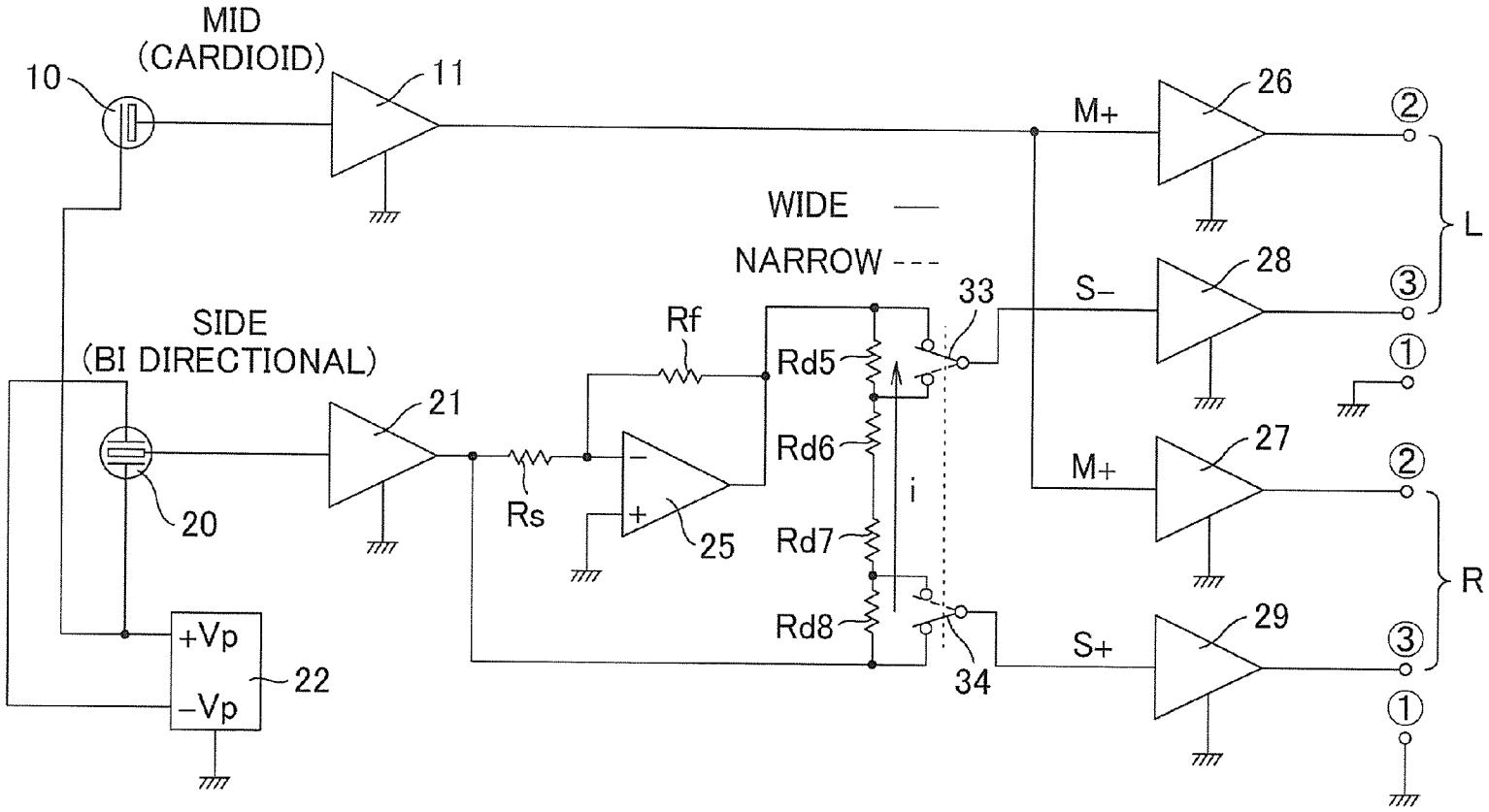
RELATED ART FIG. 7
FIG. 7 is a circuit diagram illustrating a further alternative conventional stereo microphone.
Figure 8A:
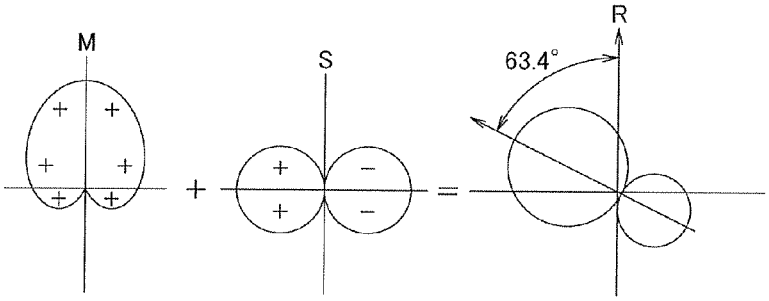
RELATED ART FIG. 8A
FIG. 8A illustrates a directional curve indicating directivity of a first channel to explain the principle of an MS stereo microphone.
Figure 8B:
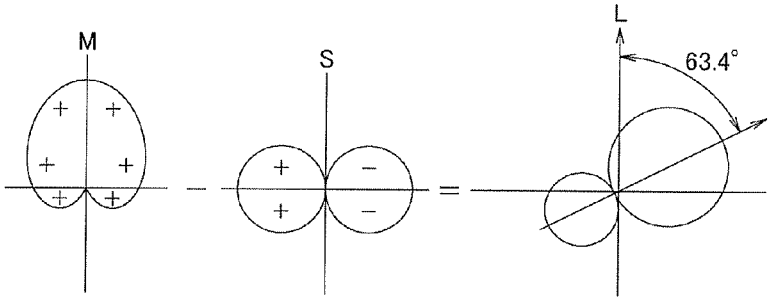
FIG. 8B illustrates a directional curve indicating directivity of a second channel to explain the principle of the MS stereo microphone.
Figure 8C:
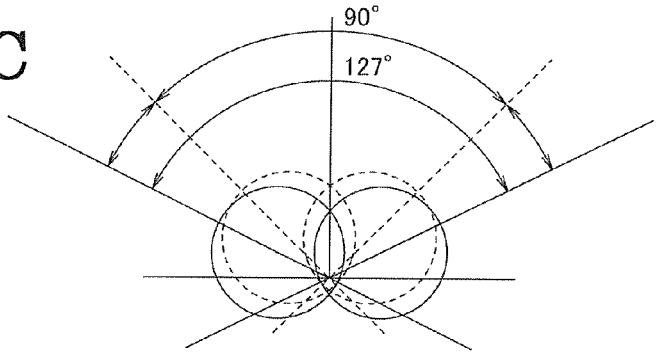
FIG. 8C illustrates a directional curve to explain the principle of a variable angle defined by left and right directional axes.

Embodiments of a stereo microphone according to the present invention are explained below with reference to the drawings. Since a mechanical configuration of the stereo microphone of the present invention can be the same as the configuration shown in FIG. 3, explanations of the mechanical configuration are omitted. In the stereo microphone of the present invention, most components of the basic circuit configuration as an MS stereo microphone are common to those of the circuit configuration shown in FIG. 5. Thus, the common reference numerals are assigned to the common components of the circuit configuration.

(First Embodiment)

Figure 1:
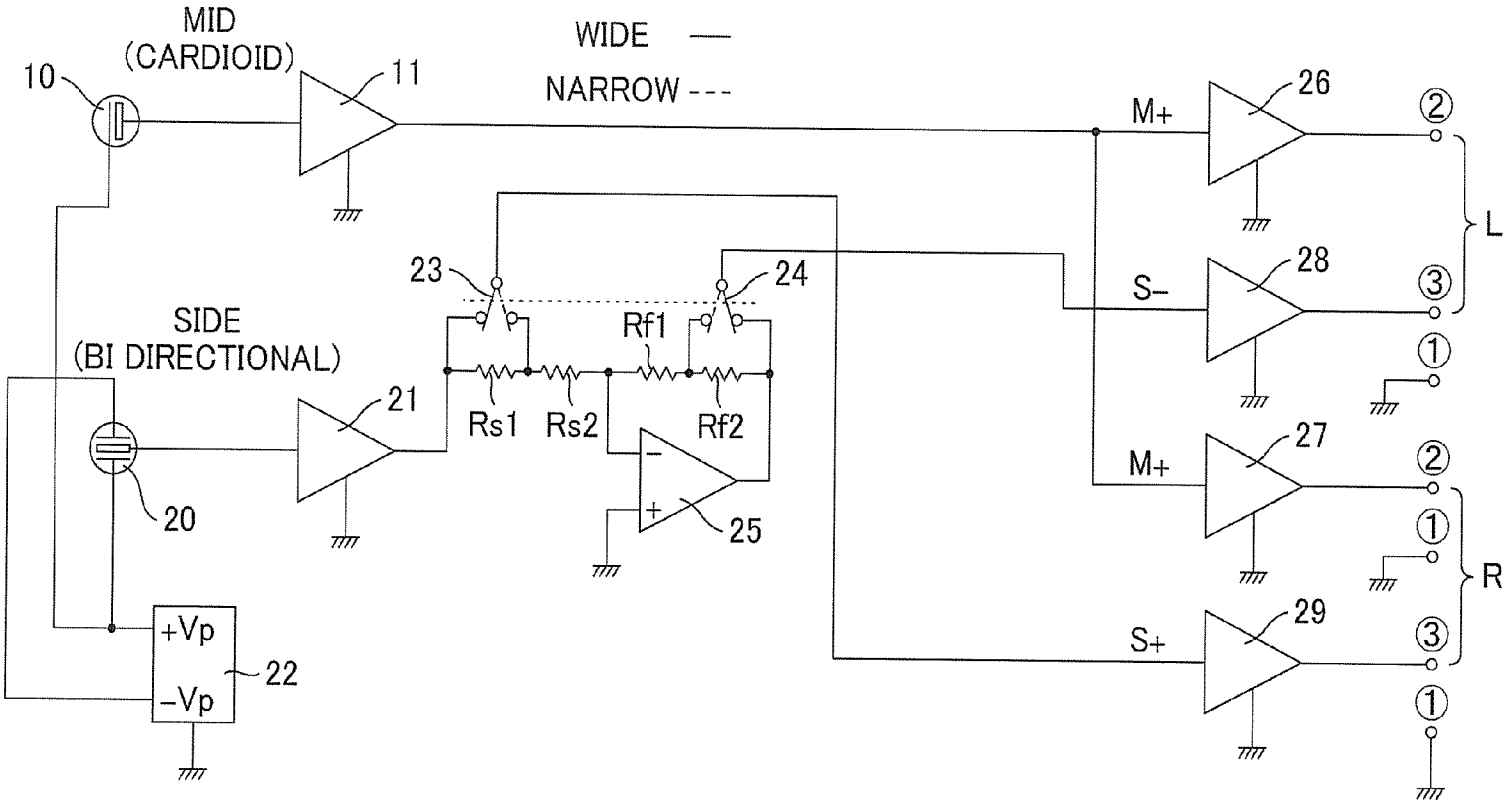
FIG. 1 is a circuit diagram illustrating a stereo microphone according to an embodiment of the present invention.

FIG. 1 shows a middle unidirectional microphone element 10 and a bidirectional side microphone element 20. These microphone elements 10 and 20 are condenser microphone elements. A polarization voltage is supplied to each of the microphone elements 10 and 20 from a power circuit 22 including a DC-DC converter. The power circuit 22 boosts a power source battery voltage of approximately 5V to approximately ±100V, and applies the voltage to a diaphragm and an opposed fixed plate of each of the condenser microphone elements. The side microphone element 20 has a fixed plate sandwiched by diaphragms, and thereby functions as two addorsed microphone elements to provide bi-directivity. A positive voltage +Vp of the power circuit 22 is applied to the first diaphragm of the side microphone element 20 while a negative voltage −Vp of the power circuit 22 is applied to the second diaphragm.

Amplifiers 11 and 21 amplify output signals from the microphone elements 10 and 20, respectively, and then output the signals. The microphone elements 10 and 20 may be provided respectively with an impedance converter. Alternatively, the amplifiers 11 and 21 may each serve as an impedance converter. In either case, the high impedance outputs of the microphone elements 10 and 20 are converted to low impedance and are output from the amplifiers 11 and 21, respectively. The amplifiers 11 and 21 are referred to as first amplifiers for explanation purposes.

The microphone outputs are separated into a left channel and a right channel. For three-pin balanced output of each channel signal, the circuit has the following configuration. The output M+ from the first amplifier 11 amplifying the output of the middle microphone element 10 is output as a hot signal from a second pin of the left channel through the amplifier 26, while the output from the amplifier 11 is output as a hot signal from a second pin of the right channel through an amplifier 27. The output end of the first amplifier 21 that amplifies the output of the side microphone element 20 is connected to an in inverting input terminal of an inverting amplifier 25 that includes a differential amplifier, through input resistors Rs1 and Rs2 in series. Feedback resistors Rf1 and Rf2 are connected between the inverting input terminal and the output terminal of the inverting amplifier 25. In the embodiment, the resistors have a relationship of Rs1+Rs2=Rf1+Rf2.

A non-inverted signal of the side microphone element 20 is output from the amplifier 21. The non-inverted signal is output as a cold signal S+ of the right channel from a third pin of the right channel through an amplifier 29. A switch 23 is provided between the amplifier 21 and the amplifier 29. The switch 23 can select either the output end of the amplifier 21 or the node of the input resistors Rs1 and Rs2 and output the signal S+. The output signal of the inverting amplifier 25, specifically the inverted signal S− of the side microphone element 20, is output as a cold signal from a third pin of the left channel through an amplifier 28. A switch 24 is provided between the inverting amplifier 25 and the amplifier 28. The switch 24 can select either the output end of the inverting amplifier 25 or the node of the feedback resistors Rf1 and Rf2 and output the signal S−. The two switches 23 and 24 are conjunction switches that operate concurrently. The switches 23 and 24 can select the output end from the amplifier 21 and the output end of the inverting amplifier 25, as represented by a solid line in FIG. 1, or select the node of the input resistors Rs1 and Rs2 and the node of the feedback resistors Rf1 and Rf2, as represented by a broken line in FIG. 1. The amplifiers 26 to 29 are all emitter-follower-connected. The amplifiers 26 to 29 are referred to as second amplifiers for explanation purposes.

If the middle output signal M from the amplifier 11 is defined as M+, an M+ signal is output from each of the second pins of the L channel and the R channel. The second pins are hot output terminals of the balanced output of the L channel and the R channel. Meanwhile, the side output signal S, which is the side output S from the amplifier 21, also has a + phase. Then, an S+ signal is output from the third pin of the right channel. The phase of the side output signal S+ from the amplifier 21 that passes through the inverting amplifier 25 is inverted to S−. The inverted signal S− is output from the third pin of the left channel through the amplifier 28. The left channel signal and the right channel signal are output from a three-pin connecter as a balanced signal. First pins are grounded; the second pins are hot signal pins, as described above; and the third pins are cold signal pins.

In the case where the two conjunction switches 23 and 24 are set as represented by the solid line in FIG. 1, the output S+ from the first amplifier 21 is directly input to the second amplifier 29 while the output S− from the inverting amplifier 25 is directly input to the amplifier 28. Thus, in the switch setting, the level of bidirectional components output from the side microphone element 20 is the highest for the non-inverted signal S+ and the inverted signal S−. Then, the angle between the directional axes of the left and right channels is the widest.

In the case where the two conjunction switches 23 and 24 are set as represented by the broken line in FIG. 1, the output S+ from the first amplifier 21, which is input to the second amplifier 29, is divided by the input resistors Rs1 and Rs2 while the output S− from the inverting amplifier 25, which is input to the second amplifier 28, is divided by the feedback resistors Rf1 and Rf2. Thus, the level of bidirectional components output from the side microphone element 20 is decreased for the non-inverted signal S+ and the inverted signal S−. Then, the angle between the directional axes of the left and right channels is narrowed. The values of the input resistors Rs1 and Rs2 and the feedback resistors Rf1 and Rf2 are set such that the non-inverted signal S+ and the inverted signal S− have the same level of absolute value.

In the first embodiment shown in FIG. 1, the division ratio is varied between the input resistors Rs1 and Rs2 and the feedback resistors Rf1 and Rf2 of the inverting amplifier 25 provided on the signal path from the side microphone element 20, which is the signal path of the bidirectional components. Thereby, the angle between the left and right directional axes can be changed. Accordingly, the amplifiers are not overloaded by the voltage-dividing resistors, thus reducing distortion of sound signals converted by the microphone. The circuit configuration is relatively simple. Furthermore, an increase in noise can be avoided, compared with a conventional means that varies a bidirectional level. Specifically, noise generated at the input resistors Rs1 and Rs2 is negligible. In addition, no noise is generated at the feedback resistors Rf1 and Rf2 since a loop is formed relative to the inverting amplifier 25. Compared with an MS stereo microphone having no means that varies bidirectional components, the bidirectional components can be varied while an increase in noise is controlled.

In the embodiment above, the value of the input resistors and the value of the feedback resistors of the inverting amplifier 25 do not change, and thus the gain of the inverting amplifier 25 does not change.

(Second Embodiment)

Figure 2:
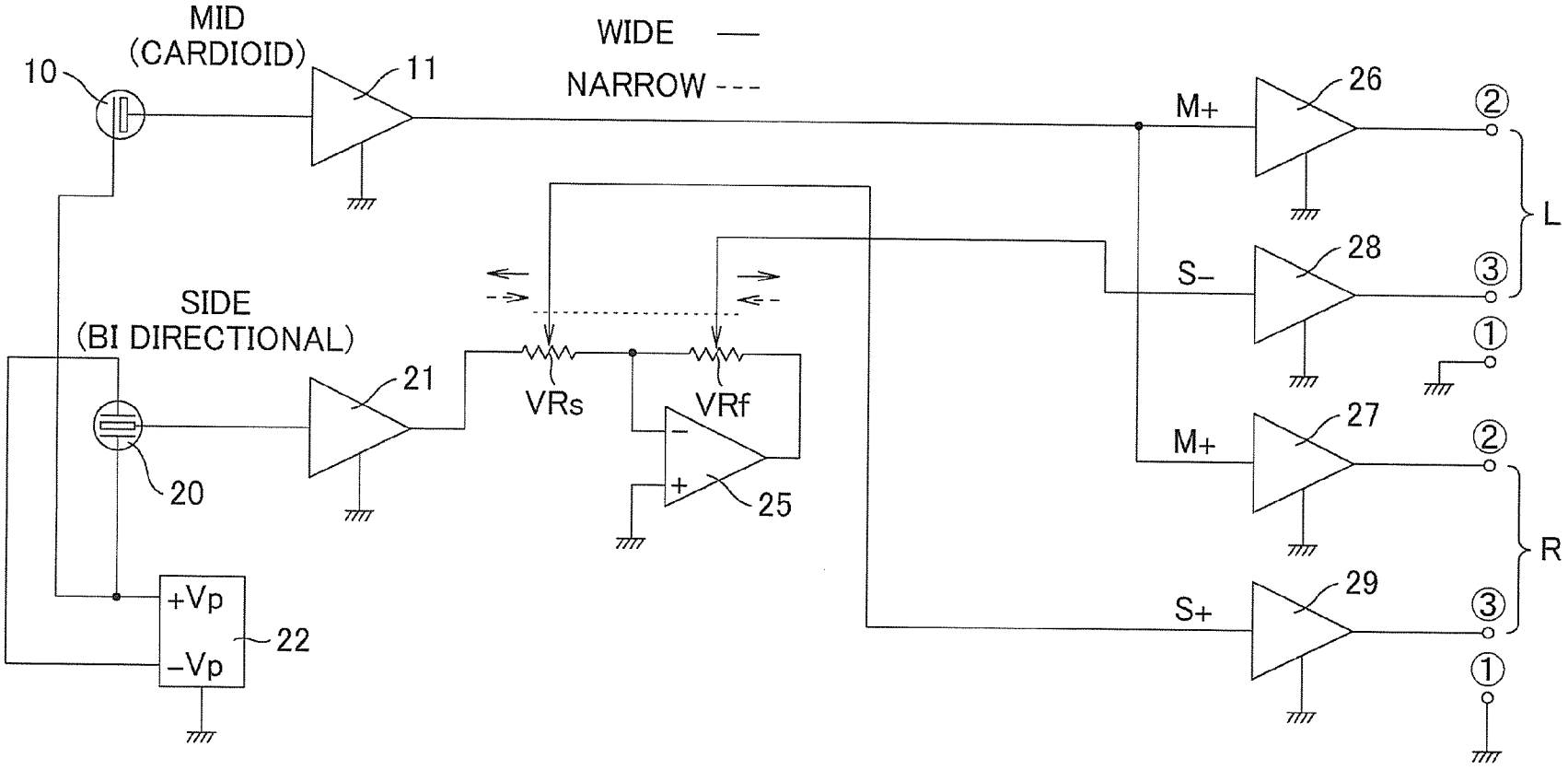
FIG. 2 is a circuit diagram illustrating a stereo microphone according to an alternative embodiment of the present invention.

FIG. 2 illustrates a second embodiment. The embodiment is different from the first embodiment shown in FIG. 1 in that, in order to vary the division ratio of an input resistor to a feedback resistor for an inverting amplifier 25, a variable resistor VRs is provided as the input resistor and a variable resistor VRf is provided as the feedback resistor. In other words, the variable resistor VRs and the variable resistor VRf are provided in place of the input resistors Rs1 and Rs2, the feedback resistors Rf1 and Rf2, and the switches 23 and 24 in the first embodiment shown in FIG. 1. The variable resistors VRs and VRf are operated in conjunction with each other through rotation of a shared axis. Operating the variable resistors continuously changes a resistance value. A movable contact of the variable resistor VRs is connected to an input terminal of a second amplifier 29 and a movable contact of the variable resistor VRf is connected to an input terminal of a second amplifier 28 such that changing the resistance value continuously and concurrently changes the level of the absolute value of a non-inverted signal S+ and an inverted signal S−, which are bidirectional components output from a side microphone element 20.

In the case where the variable resistors VRs and VRf are operated in directions represented by solid arrows in FIG. 2 to their limit positions, the levels of the non-inverted signal S+ and the inverted signal S− are the highest. Thus, the angle between the directional axes of the left and right channels is the widest. In the case where the variable resistors VRs and VRf are operated in directions represented by broken lines in FIG. 2, the levels of the non-inverted signal S+ and the inverted signal S− are divided by the variable resistors VRs and VRf, respectively, and continuously decreased at the same level. Thus, the angle between the directional axes of the left and right channels is continuously narrowed.

In the second embodiment shown in FIG. 2, the inverting amplifier 25 is connected to a latter stage of a first amplifier 21, and the variable resistors are used as the input resistor and the feedback resistor of the inverting amplifier 25, in order to produce the inverted signal of the side microphone element 20. Thus, the levels of the non-inverted signal S+ and the inverted signal S− of the side microphone element 20 are changed, the non-inverted signal S+ and the inverted signal S− being added to an output signal of a middle microphone element 10. Thereby, the angle between the directional axes of the left and right channels can be changed. Accordingly, the amplifiers are not overloaded as well in the second embodiment shown in FIG. 2, thus reducing distortion of sound signals converted by the microphone. Furthermore, advantageous effects similar to those in the first embodiment can be achieved, including a relatively simple circuit configuration and no noise generation from the input resistor and the feedback resistor.

In the second embodiment, the value of the input resistor and the value of the feedback resistor of the inverting amplifier 25 do not change as well, and thus the gain of the inverting amplifier 25 does not change.

The embodiments shown in the drawings are exemplary embodiments of the present invention. The design may be modified as desired within the scope of the technical concept recited in claims. Both the middle microphone element and the side microphone element are explained as condenser microphone elements. As long as the middle microphone element is unidirectional and the side microphone element is bidirectional, however, any type of microphone elements may be employed. Furthermore, the middle microphone element and the side microphone element may be different types from each other.

What is claimed is:

1. A stereo microphone, comprising:

a middle microphone element having unidirectivity and having a directional axis; and a side microphone element having bi-directivity and having a directional axis disposed orthogonal to the directional axis of the middle unidirectional microphone element, wherein the side microphone element comprises an output circuit including an inverting amplifier, the inverting amplifier inverting a phase of an output signal of the side microphone element and outputting an inverted output signal, the inverting amplifier includes at least one input resistor and at least one feedback resistor, a non-inverted output signal of the side microphone element and an output signal of the middle microphone element produce a first signal for one channel of left and right channels, the inverted output signal of the side microphone element and the output signal of the middle microphone element produce a second signal for the other channel of the left and right channels, the at least one input resistor and the at least one feedback resistor for the inverting amplifier are dividable, and the at least one input resistor and the at least one feedback resistor are usable to vary one or more of a value of the non-inverted output signal and a value of the inverted output signal without changing the gain of the inverting amplifier, and thereby an angle between directional axes of said left and right channels is changeable, the input resistor is connected to a first switch having at least a first configuration and a second configuration, the value of the non-inverted output signal is reduced by the at least one input resistor when the first switch is in the first configuration as compared to the value of the non-inverted output signal when the first switch is in the second configuration, the feedback resistor is connected to a second switch having at least a third configuration and a fourth configuration, the value of the inverted output signal is reduced by the at least one feedback resistor when the second switch is in the third configuration as compared to the value of the inverted output signal when the second switch is in the fourth configuration, and the first switch and the second switch are conjunction switches that operate concurrently.

2. The stereo microphone according to claim 1, wherein the one channel of the left and right channels balance-outputs the output signal from the middle microphone element as a hot signal and the inverted output signal from the side microphone element as a cold signal; and the other channel of the left and right channels balance-outputs the output signal from the middle microphone element as a hot signal and the non-inverted output signal from the side microphone element as a cold signal.

3. The stereo microphone according to claim 1, wherein an output end of the middle microphone element and an output end of the side microphone element are respectively connected with first amplifiers, and signals are output from the middle and side microphone elements through the respective first amplifiers.

4. The stereo microphone according to claim 3, wherein the non-inverted output signal is output from the first amplifier of the side microphone element, and the inverting amplifier is connected to a latter stage of the first amplifier to produce the inverted output signal of the side microphone element.

5. The stereo microphone according to claim 2, wherein respective output circuits of the hot signals and the cold signals of the left and right channels are emitter-follower-connected with second amplifiers.

6. The stereo microphone according to claim 1, wherein both the middle microphone element and the side microphone element are condenser microphone elements.

7. The stereo microphone according to claim 1, wherein the at least one input resistor and the at least one feedback resistor are connected such that the respective division ratio is the same and that an absolute value of the non-inverted output signal and an absolute value of the inverted output signal of the side microphone element are the same.

8. The stereo microphone according to claim 1, wherein said at least one input resistor and said at least one feedback resistor each include at least two resistors.

9. A stereo microphone, comprising:

a middle microphone element having unidirectivity and having a directional axis; and a side microphone element having bi-directivity and having a directional axis disposed orthogonal to the directional axis of the middle unidirectional microphone element, wherein the side microphone element comprises an output circuit including an inverting amplifier, the inverting amplifier inverting a phase of an output signal of the side microphone element and outputting an inverted output signal, an input resistor of the inverting amplifier comprises a first variable contact, a feedback resistor of the inverting amplifier comprises a second variable contact, a non-inverted output signal of the side microphone element is output from the first variable contact, the inverted output signal of the side microphone element is output from the second variable contact, the non-inverted output signal and an output signal of the middle microphone element produce a first signal for one channel of left and right channels, the inverted output signal and the output signal of the middle microphone element produce a second signal for the other channel of the left and right channels, the input resistor and the feedback resistor for the inverting amplifier are dividable, and a value of the non-inverted output signal is varied by a variation of the first variable contact and a value of the inverted output signal is varied by a variation of the second variable contact, and thereby an angle between directional axes of said left and right channels is changeable, the first variable contact has at least a first configuration and a second configuration, the value of the non-inverted output signal is reduced by the at least one input resistor when the first variable contact is in the first configuration as compared to the value of the non-inverted output signal when the first variable contact is in the second configuration, the second variable contact has at least a third configuration and a fourth configuration, the value of the inverted output signal is reduced by the at least one feedback resistor when the second variable contact is in the third configuration as compared to the value of the inverted output signal when the second variable contact is in the fourth configuration, and the first variable contact and the second variable contact are operated concurrently and in conjunction with each other.

10. The stereo microphone according to claim 9, wherein the first variable contact and the input resistor are configured as a first variable resistor, and the second variable contact the feedback resistor are configured as a second variable resistor.

11. The stereo microphone according to claim 10, wherein the first variable resistor and the second variable resistor are operable in conjunction with each other, and the variable resistors are connected such that operation thereof continuously changes levels of the non-inverting output signal and the inverted output signal at the same level.

12. The stereo microphone according to claim 9, wherein the first variable contact and the second variable contact are usable to vary one or more of the value of the non-inverted output signal and the value of the inverted output signal without changing the gain of the inverting amplifier.

* * * * *